United States Patent [19]

Ukegawa et al.

[11] Patent Number: 5,013,975

[45] Date of Patent: May 7, 1991

[54] ELECTRODELESS DISCHARGE LAMP

[75] Inventors: Shin Ukegawa; Masaki Shinomiya; Masahiro Higashikawa; Tadao Uetsuki; Koichi Kobayashi, all of Kadoma, Japan

[73] Assignee: Matsushita Electric Works, Ltd., Japan

[21] Appl. No.: 439,873

[22] Filed: Nov. 21, 1989

[30] Foreign Application Priority Data

| | | | |
|---|---|---|---|
| Dec. 22, 1988 | [JP] | Japan | 63-324024 |
| May 23, 1989 | [JP] | Japan | 1-129244 |
| Jun. 15, 1989 | [JP] | Japan | 1-153118 |

[51] Int. Cl.[5] ..... H05B 41/16

[52] U.S. Cl. ..... 315/248; 315/39; 313/642

[58] Field of Search ..... 315/248, 39, 111.51, 315/267, 283, 344, 358; 313/642, 490

[56] References Cited

U.S. PATENT DOCUMENTS

| | | | |
|---|---|---|---|
| 1,858,912 | 4/1932 | Spaeth | 315/248 |
| 3,227,923 | 1/1966 | Marrison | 315/248 |
| 4,010,400 | 3/1977 | Hollister | 315/248 |
| 4,024,431 | 5/1977 | Young | 315/248 |
| 4,171,503 | 10/1979 | Kwon | 315/248 |
| 4,178,534 | 12/1979 | McNeil | 315/248 |
| 4,206,327 | 6/1980 | Kramer | 315/248 |
| 4,568,859 | 12/1986 | Hawker | 315/248 |

FOREIGN PATENT DOCUMENTS

| | | | |
|---|---|---|---|
| 0198523 | 10/1986 | European Pat. Off. | 313/642 |
| 1191482 | 4/1965 | Fed. Rep. of Germany . | |
| 52-44083 | 10/1975 | Japan | 313/642 |
| 58-1511 | 1/1983 | Japan | 315/248 |

*Primary Examiner*—Eugene R. Laroche
*Assistant Examiner*—Amir Zarabian
*Attorney, Agent, or Firm*—Leydig, Voit & Mayer

[57] ABSTRACT

An electrodeless discharge lamp includes a lamp tube coated on inner surface with a fluorescent material and filled with mercury vapor and a rare gas where the gas provides an excitation luminescence of the same series of color as luminous color of the fluorescent material. The gas and vapor in the tube effectively maintain the luminescence of the lamp over a wide ambient temperature range where the rare gas provides luminescence of a selected color at lower temperatures and the mercury vapor and fluorescent material provide luminescence of the same color in the middle and higher temperature ranges.

12 Claims, 5 Drawing Sheets

ELECTRODELESS DISCHARGE LAMP

TECHNICAL BACKGROUND OF THE INVENTION

This invention relates to an electrodeless discharge lamp which does not have an electrode disposed inside lamp tube and which provides excitation luminescence of discharging gases within the lamp tube to be generated by means of an external application of a high frequency electromagnetic field.

The electrodeless discharge lamp of the kind referred to can be effectively utilized for use in outdoor display apparatus or color lamp installation for decorative purposes and the like.

DESCRIPTION OF THE RELATED ART

Discharge color lamps in general, have electrodes disposed in a lamp tube filled with a gas mixture of, for example, neon and argon gases, to obtain, for example, a red color luminescence. An example of a color discharge lamp is disclosed in Japanese Patent Application Laid-Open Publication No. 58-68862 by T. Seisho et al. While in such lamps the neon gas provides excellent luminous efficiency when used under a relatively low pressure, one extant problem is discharge across electrodes within the low pressure gas which causes intense scattering of the electrode substance, and in particular, the emitter substance. Such scatter significantly shortens the life of the discharge lamp. Another aim of Seisho et al is to provide a discharge lamp an excitation luminescence of the mixture gas. However, Seisho et al ignores visible light emission that would occur from use of an interposed fluorescent material. Thus, even Seisho et al does not solve the problem of obtaining a sufficient quantity of light.

In order to prolong the life of the discharge lamp, electrodeless discharge lamp structures have been suggested. These structures provide a benefit of minimizing the lamp size while still attaining a high light output. In U.S. Pat. No. 4,010,400 of D. D. Hollister, for example, an electrodeless discharge lamp is provided in which a tubular coil is mounted in the center of a glass tube lamp filled with a mixture gas of mercury vapor and an inert gas, such as argon. With this arrangement, a high frequency electric current is conducted through the internally disposed coil causing an electromagnetic field to be generated. The electromagnetic field induces excitation luminescence by ionizing the mercury vapor thus causing discharge of ultraviolet light which impinges on the phosphor which converts the ultraviolet light to visible light. In Hollister, however, the electromagnetic coupling only takes place exclusively in the electromagnetic field peripheral about the coil due to the central disposition of the coil in the lamp tube. Thus, the electromagnetic coupling does not take place in the interior of the coil where the electromagnetic field becomes relatively stronger which prevents higher efficient discharge of the mercury vapor. Further, in Hollister, the visible light is undifferentiated and the inert gas is utilized merely as a buffer gas. The buffer gas does not contribute to the luminescence, in particular, to specific color luminescence.

Accordingly, there is a need for a long lived, discharge lamp which has improved luminous efficiency while retaining a small size.

FIELD OF ART

A primary object of the present invention is, therefore, to provide an electrodeless discharge lamp which has a significantly extended life and where the gas sealed gas in the lamp tube effectively contributes to the lamps luminescence to provide a desired quantity of light over a wide range of temperatures (a low temperature zone to a higher temperature zone).

According to the present invention, this object is satisfied by means of an electrodeless discharge lamp in which an excitation luminescence of mercury vapor in a lamp tube of a light transmitting material results from conduction of high frequency electric current through an induction coil means provided along outer periphery of the lamp tube. The inner surface of the lamp tube is coated with a fluorescent material and a rare gas is included with the mercury vapor which generates an excitation luminescence of the same series of color as a luminous color of the fluorescent material within the tube is filled therein in addition to the mercury vapor.

Other objects and advantages of the present invention shall be made clear in following explanation of the invention detailed with reference to embodiments shown in accompanying drawings.

The present invention shall now be explained with reference to the respective embodiments shown in accompanying drawings, but the intention is not to limit the invention only to the embodiments shown but rather to include all modifications, alterations and equivalent arrangements possible within the scope of appended claims.

DISCLOSURE OF PREFERRED EMBODIMENTS

Figure 1:
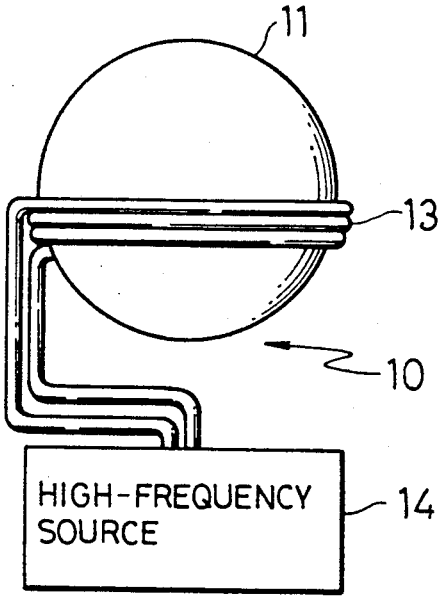
FIG. 1 is a schematic view showing in an embodiment the electrodeless discharge lamp according to the present invnetion.
Figure 2:
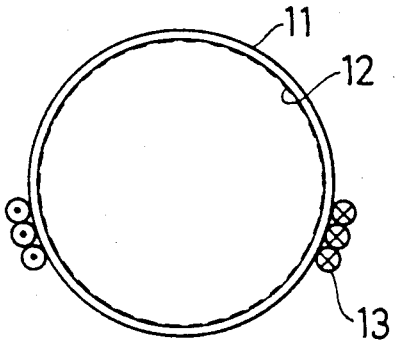
FIG. 2 is a schematic sectioned view of the lamp in FIG. 1.

Referring to FIGS. 1 and 2, an electrodeless discharge lamp 10 in an embodiment according to the present invention comprises a gas-tight lamp tube 11 formed of such light transmitting material as a glass. A fluorescent material 12 is applied to inner wall surface of the tube 11, preferably, substantially over the entire inner surface, and a discharge gas consisting of mercury vapor Hg and neon gas Ne is filled in the tube 11. In this case, the filling amount of the neon gas is made to be of a level at which the neon gas alone can realize the luminescence by a electrodeless discharging even when, for example, the mercury vapor is absent in the tube 11. An induction coil 13 is wound along the entire outer periphery of the tube 11 as disposed in engagement therewith or in proximate thereto, and a high-frequency source 14 is connected to the induction coil 13 for causing a high frequency electric current to flow therethrough.

Now, as the high frequency electric current is made to flow from the high-frequency source 14 through the induction coil 13 in the foregoing discharge lamp 10, an electromagnetic field is induced in well known manner. In an event where, for example, the ambient temperature is above 0° C., mainly the mercury gas will be effective as the discharging gas here so that mercury atoms will carry out an excitation luminescence. The emitted ultraviolet rays of a main band of frequency of 254 nm are converted by the fluorescent material 12 into a visible light, and a red color luminescence of light of a main band of 610 nm takes place. At this time, the neon gas filled in the tube 11 along with the mercury vapor functions as a buffer gas so as to control electron energy at a value for easy excitation of mercury atoms. In an event of a low ambient temperature below 0° C., on the other hand, the number of atoms of gaseous mercury is not at a level of maintaining the mercury discharge so that the neon gas will act as the discharge gas, and the red color luminescence is realized. Here, the excitation luminescence of the neon gas is carried out with a red color bright line luminescence at about 640 nm utilized.

Figure 3:
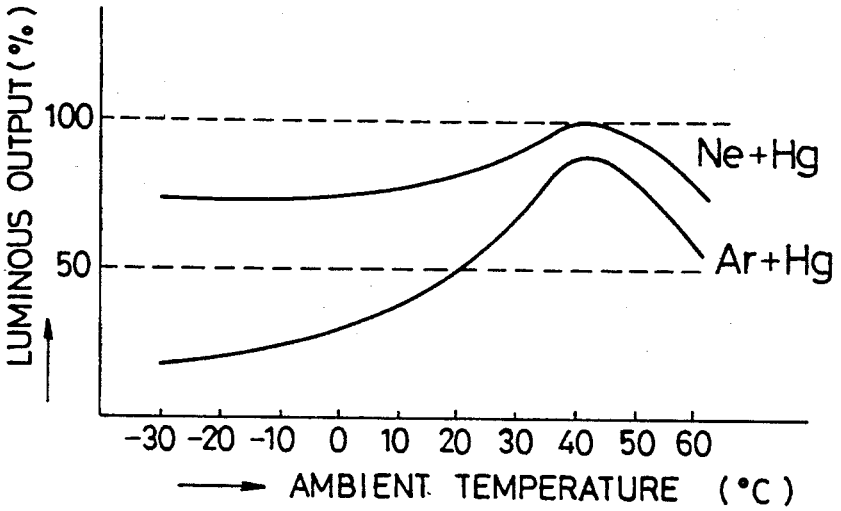
FIG. 3 is a diagram showing characteristics of luminous output with respect to ambient temperature in the lamp of FIG. 1.
Figure 4:
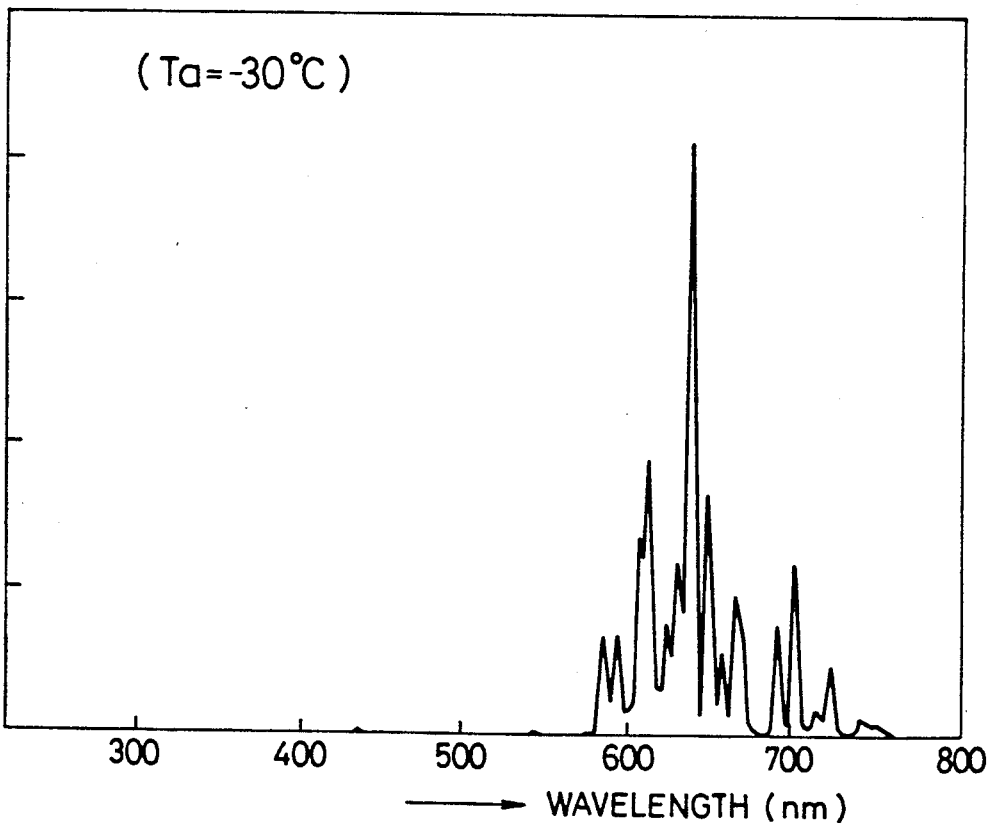
FIGS. 4 through 8 are diagrams showing spectrum distribution in the electrodeless discharge lamp according to the present invention.
Figure 5:
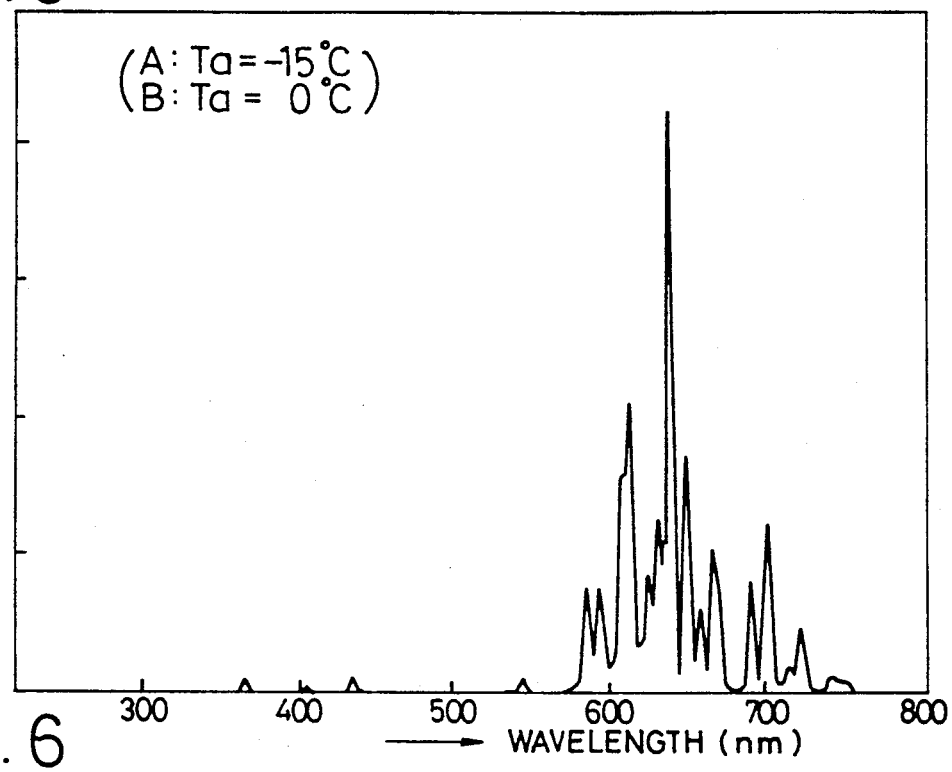
Figure 6:
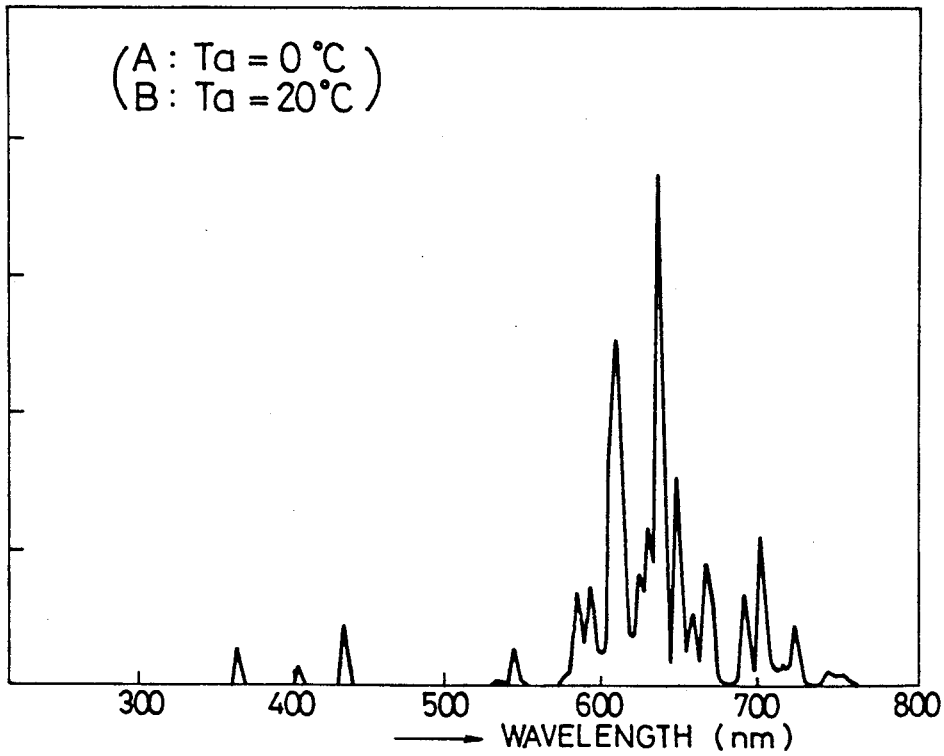
Figure 7:
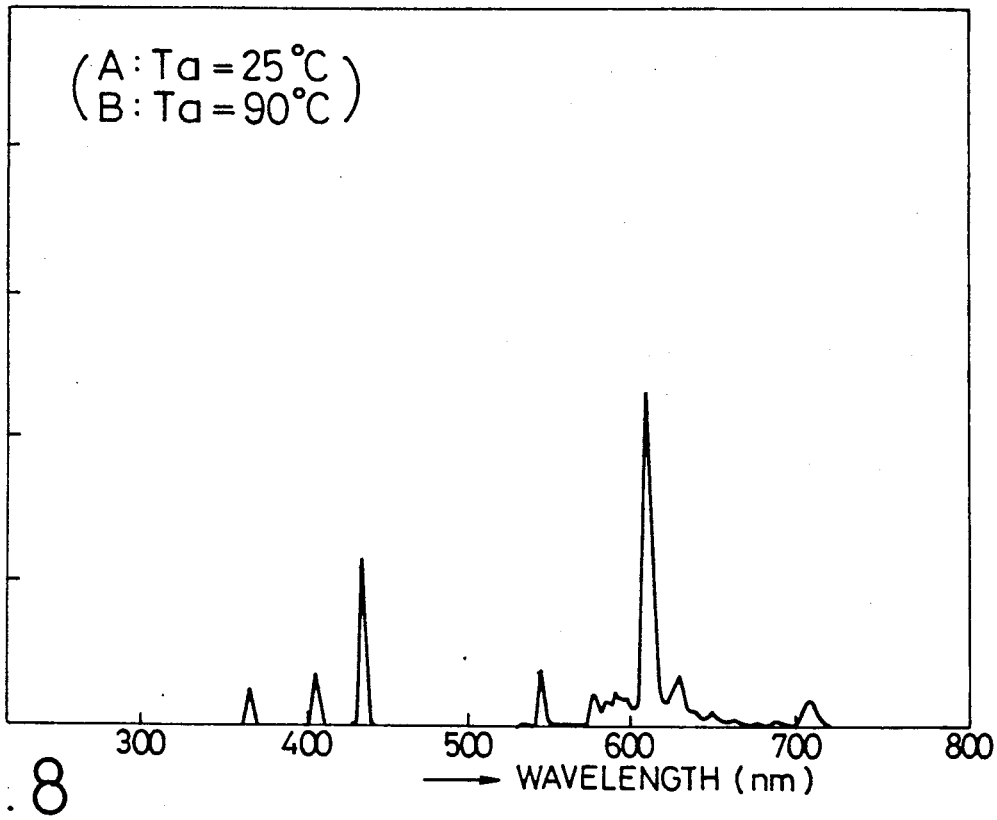
Figure 8:
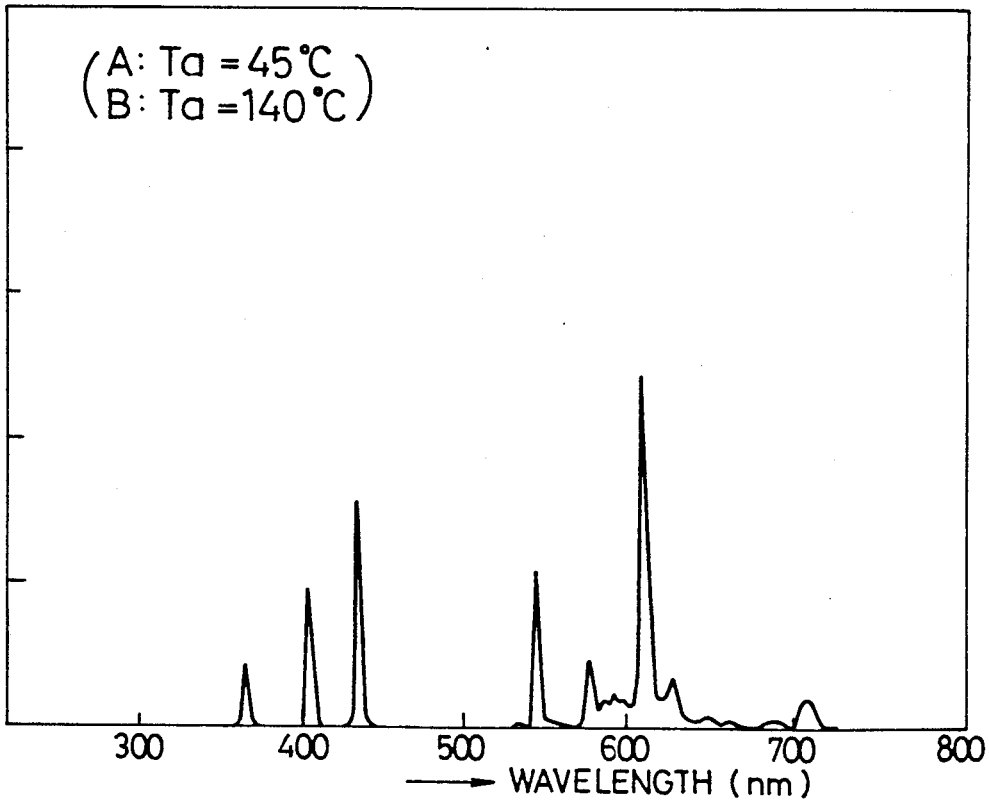

According to the foregoing arrangement, as will be clear from FIG. 3, it has been found that the lamp 10 according to the present invention allows an excellent luminous output to be obtained over such a wider range of the ambient temperature from −30° C. to 60° C. as compared with a case where the gas filled in the tube is a mixture of mercury vapor Hg and argon Ar. Further in FIGS. 4 through 8, there are shown spectrum distributions in the discharge lamp 10 of FIGS. 1 and 2 with such a variety of ambient temperature Ta as Ta=−30° C. in FIG. 4, Ta=−15° C. in FIG. 5, Ta=0° C. in FIG. 6, Ta=25° C. in FIG. 7 and Ta=45° C. in FIG. 8, while spectrum strength is shown as subjected to a reduction for easier drafting. As will be seen in FIGS. 4 and 5, in particular, it should be appreciated that an excellent rise of the excitation luminescence can be attained in the low temperature zone by means of the electrodeless discharge lamp 10 with the mercury vapor and neon gas filled in.

According to another embodiment of the present invention, the gas filled in the lamp tube 11 in the electrodeless discharge lamp of FIGS. 1 and 2 includes, in addition to the mercury vapor and neon gas, a small amount (for example, about 1%) of argon gas added to the neon gas. With this arrangement, the discharge lamp 10 can be made startable with a relatively low starting voltage even at an extremely low ambient temperature with the Penning's effect between neon and argon utilized. Other arrangement and operation of this embodiment are substantially the same as those in the foregoing embodiment of FIGS. 1 through 8.

Figure 9:
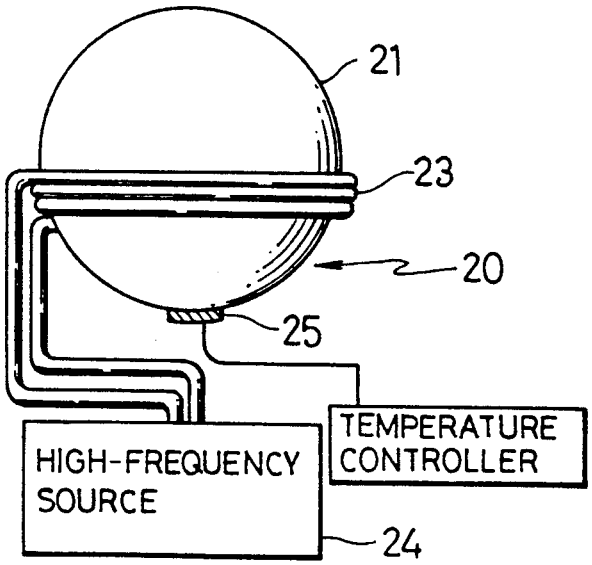
FIG. 9 is a schematic view showing in another embodiment the electrodeless discharge lamp according to the present invention.

Referring now to FIG. 9, there is shown an electrodeless discharge lamp 20 in still another embodiment of the present invention, which comprises, in addition to similar arrangement to the embodiment of FIGS. and 2 of a lamp tube 21 with the mercury vapor and neon gas filled therein and an induction coil 23 wound on the outer periphery of the tube 21 and connected to a high-frequency source 24 for flowing the high frequency current to the coil 23, a temperature control means 25 mounted onto the outer periphery of the lamp tube 21 for varying the temperature in the tube 21. According to this embodiment, the coldest point of the interior of the tube 21 can be varied, so that the mercury vapor pressure will be responsive to the temperature at the coldest point in the tube 21, and the neon gas will carry out the red color luminescence, for example, only when the temperature is considerably low. Further, the luminescence in a variety of colors can be also realized in accordance with rise of the coldest point, by properly selecting the fluorescent material to be applied to the inner wall of the lamp tube 21. Other arrangement and operation of this embodiment are substantially the same as those in the foregoing discharge lamp 10 of FIGS. 1 and 2.

Figure 10:
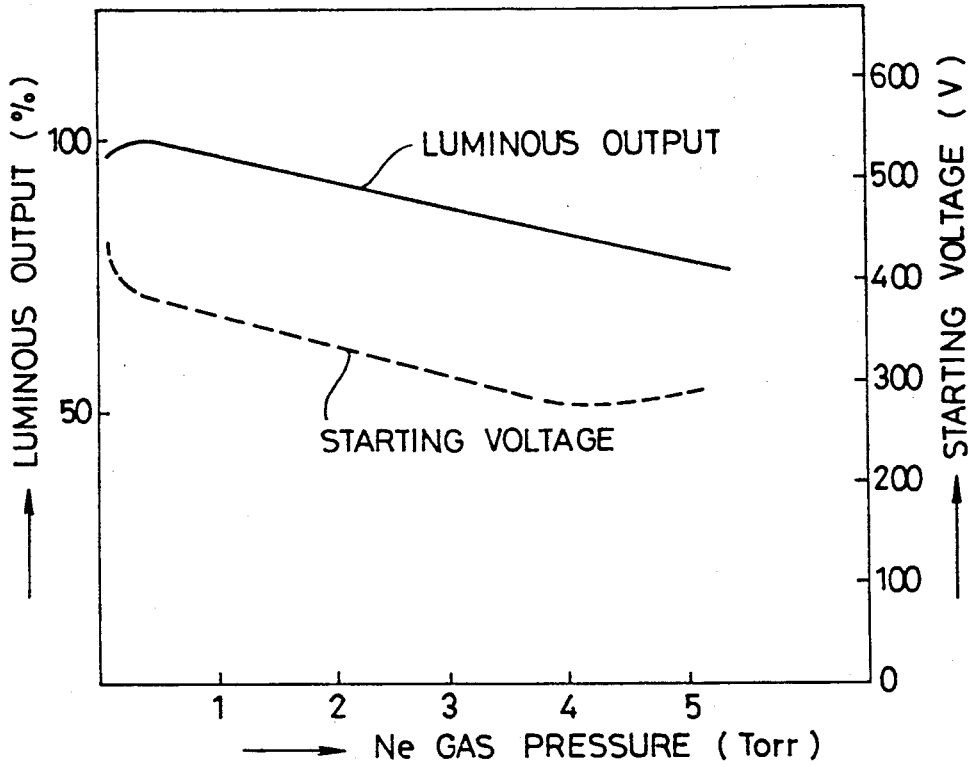
FIG. 10 is a diagram showing characteristics of luminous output with respect to Ne gas pressure in another embodiment of the lamp according to the present invention.

In a further aspect of the present invention, the neon gas is filled in the lamp tube 11 or 21 under a pressure of 0.3–3.0 Torr. That is, referring to FIG. 10, it is seen that the luminous output increases as the neon gas pressure within the lamp tube 11 or 21 is lowered, but this causes at the same time the starting voltage to be elevated so that, when the neon gas pressure within the tube 11 or 21 is less than 0.3 Torr, the starting will be rather ill affected while, when the neon gas pressure in the tuve 11 or 21 is higher than 3.0 Torr, the starting becomes easier but the luminous output is too lowered. The discharging of the neon gas under the relatively lower pressure thus causes in particular the emmitter electrode to be intensely scattered to be quickly worn out. According to the present invention, however, the lamp is of the electrodeless type and no wear of the electrodes takes place. Other arrangement and operation in this aspect of the present invention are substantially the same as those in the discharge lamp 10 of FIGS. 1 and 2.

In still another aspect of the present invention, the neon gas pressure can be reduced while, as has been partly referred to, argon gas of a smaller amount than the neon gas (for example, about 1%) is added to the filling gas of the mercury vapor and neon gas in the lamp tube 11 or 21, and the gas pressure in total of the neon and argon gases is set to be 0.3 Torr. It will be appreciated that, in the present aspect of the invention, the discharge lamp can be effectively started with the Penning's effect between neon and argon, even with the neon and argon gas pressure below 0.3 Torr. Other arrangement and operation in the present aspect are substantially the same as those in the discharge lamp 10 of FIGS. 1 and 2.

Further, in either one of the above aspects in which the neon gas pressure is at 0.3–3.0 Torr of the neon and argon gas pressure is below 0.3 Torr, the discharge lamp can be provided with such temperature control means as shown in FIG. 9.

Figure 11:
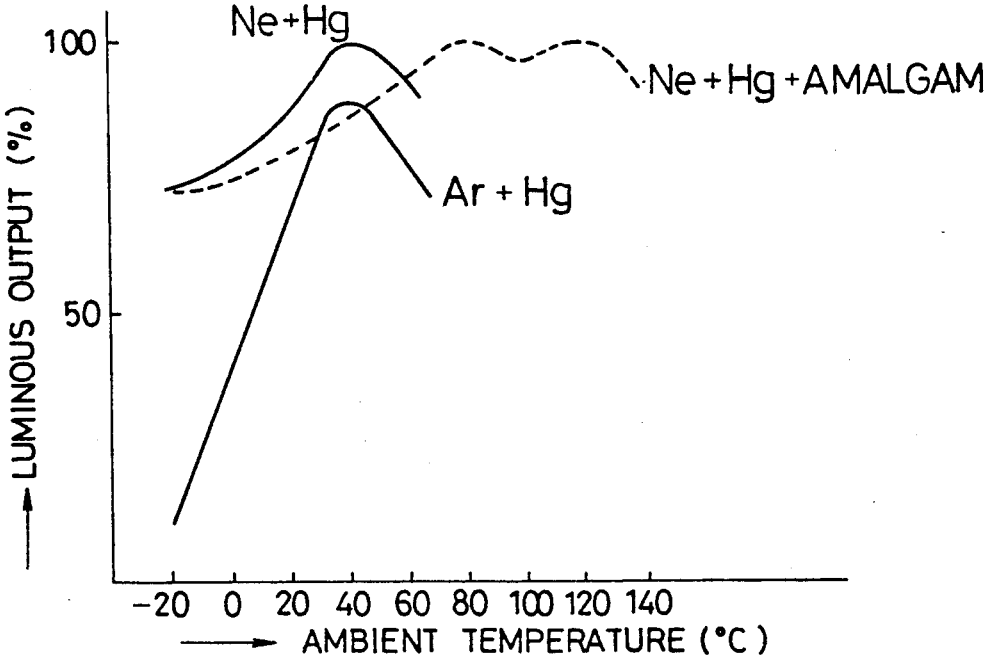
FIG. 11 is a diagram showing characteristics of luminous output with respect to ambient temperature in still further embodiment of the lamp according to the present invention.

According to a still further aspect of the present invention, a mercury amalgam, for example, Bi-In-Hg amalgam is filled in the lamp tube 11 or 21 in the foregoing embodiment, in addition to the mercury vapor and neon gas, so that the discharge lamp can be made designable to have the optimum vapor pressure obtained adjacent 80° C. and 120° C. as shown by a broken-line curve of Ne=Hg=Amalgam in FIG. 11, as a result of the addition of the amalgam. In this diagram, "ambient temperature" means the temperature close to the lamp surface. Considering the casing of this lamp is used in a fixture, "ambient temperature" is much higher than atmospheric temperature outside the fixture. Further, the optimum temperature for obtaining the optimum vapor pressure can be modified by varying the ratio of the amalgam with respect to the amount of mercury, as required. According to this aspect, while the spectrum distributions shown in FIG. 5–8 are obtainable in the embodiment of FIGS. 1 and 2 under such ambient temperature Ta as denoted by "A" in the drawings, i.e., −15° C. in FIG. 5, 0° C. in FIG. 6, 25° C. in FIG. 7 and 45° C. in FIG. 8, the same spectrum distributions can be obtained in the present aspect under such higher ambient temperature Ta as denoted by "B", i.e., 0° C. in FIG. 5, 20° C. in FIG. 6, 90° C. in FIG. 7 and 140° C. in FIG. 8, so that the discharge lamp according to the present invention can be smoothly operated in a further wide range of the ambient temperature. Here, it is noted that, when the ambient temperature is −30° C., both of the embodiment of FIGS. 1 and 2 and the present aspect show the same spectrum distribution. Other arrangement and operation of the present aspect are substantially the same as in the embodiment of FIGS. 1 and 2.

In the above aspect of the invention in which the amalgam is added, it is also possible to attempt lowering the starting voltage by the addition of small amount of argon gas to the neon gas to utilize the Penning's effect between neon and argon. Further in this aspect, too, the discharge lamp can be provided with the temperature control means of FIG. 9 so as to vary the coldest point temperature in the lamp tube.

What is claimed is:

1. An electrodeless discharge lamp comprising a lamp tube formed of a light transmitting material, an induction coil means in proximity to an outer periphery of said lamp tube which conducts a high frequency electric current upon excitation by a high frequency source, a fluorescent material applied to an inner surface of said lamp tube, mercury vapor in said lamp tube having an excitation luminescence upon conduction of high frequency current by said induction coil means and a rare gas in said lamp tube which together with said mercury vapor generates an excitation luminescence of the same series of color as the color series of the visible light emitted by said fluorescent material, said fluorescent material and said gaseous composition being capable of sustaining substantially stable luminescence and substantially stable color over a wide range of ambient temperatures.

2. The lamp according to claim 1, wherein said fluorescent material is for a red color luminescence, and said rare gas is neon.

3. The lamp according to claim 2, wherein said neon gas is filled under a pressure 0.3–3.0 Torr.

4. The lamp according to claim 2, wherein said rare gas includes a relatively small amount of argon gas.

5. The lamp according to claim 4, wherein said argon gas is added to said neon gas by a relatively small amount, and said neon and argon gases in total are filled under a pressure below 0.3 Torr.

6. The lamp according to claim 1, which further comprises a temperature control means provided for controlling the coldest point temperature in said lamp tube.

7. The lamp according to claim 1, wherein said rare gas further includes mercury amalgam added to said mercury vapor.

8. An electrodeless discharge lamp comprising a lamp tube formed of a light transmitting material, an induction coil means in proximity to an outer periphery of said lamp tube which conducts a high frequency electric current upon excitation by a high frequency source, a fluorescent material applied to an inner surface of said lamp tube, and a gaseous composition including mercury vapor and a rare gas in said lamp tube for an excitation luminescence upon conduction of said high frequency current through said induction coil means over a temperature range from below 0° C. to at least 60° C., said rare gas generating an excitation luminescence of a color series the same as the color series of the visible light emitted by said fluorescent material, said fluorescent material and said gaseous composition being capable of sustaining substantially stable luminescence and substantially stable color over a wide range of ambient temperatures.

9. An electrodeless discharge lamp according to claim 8 operable over an ambient temperature range of −+° C. to 140° C.

10. An electrodeless discharge lamp according to claim 9 where the rare gas is neon for producing excitation luminescence in the red color series.

11. An electrodeless discharge lamp according to claim 9 where the rare gas is neon and argon and the lamp is startable with low starting voltage at low ambient temperature in said temperature range.

12. An electrodeless discharge lamp according to claim 9 further including a Bismuth-Indium-Mercury amalgam in said lamp tube.

* * * * *

UNITED STATES PATENT AND TRADEMARK OFFICE

CERTIFICATE OF CORRECTION

PATENT NO. : 5,013,975

DATED : May 7, 1991

INVENTOR(S) : Ukegawa et al

It is certified that error appears in the above-identified patent and that said Letters Patent is hereby corrected as shown below:

Column 6, line 39, change "+" to --30--.

Signed and Sealed this

Thirteenth Day of October, 1992

*Attest:*

DOUGLAS B. COMER

*Attesting Officer*

*Acting Commissioner of Patents and Trademarks*